United States Patent [19]
Raber et al.
[11] 4,287,515
[45] Sep. 1, 1981

[54] FIRE DETECTION SYSTEM WITH MULTIPLE OUTPUT SIGNALS

[75] Inventors: Samuel Raber, Allendale; John M. Wynne, Oak Ridge; Alan M. Heim, Florham Park, all of N.J.

[73] Assignee: Baker Industries, Inc., Parsippany, N.J.

[21] Appl. No.: 33,777

[22] Filed: Apr. 27, 1979

[51] Int. Cl.[3] ..... G08B 17/06

[52] U.S. Cl. ..... 340/584; 340/506; 340/510; 340/517; 340/650

[58] Field of Search ..... 340/584, 587, 588, 506, 340/507, 508, 510, 628, 629, 630, 521, 517, 650; 169/23, 61, 60, 56

[56] References Cited

U.S. PATENT DOCUMENTS

| | | | |
|---|---|---|---|
| 2,684,475 | 7/1954 | Lode | 340/508 |
| 3,775,761 | 11/1973 | Kobayashi et al. | 340/587 |
| 3,778,796 | 12/1973 | Honda | 340/517 |
| 3,821,734 | 6/1974 | Herrliberg et al. | 340/587 |
| 3,832,678 | 8/1974 | Gysell et al. | 340/587 |
| 4,149,159 | 4/1979 | Dätwyler et al. | 340/585 |
| 4,162,489 | 7/1979 | Thilo et al. | 340/584 |

*Primary Examiner*—Glen R. Swann, III
*Attorney, Agent, or Firm*—James J. Jennings

[57] ABSTRACT

A fire detection system includes a single conductor pair for both supplying the energizing voltage to all of the fire detectors in the protected area and receiving back status information regarding the individual detector operation. The system provides individual, successive alarm outputs to regulate successive functions such as "evacuate the area", "dump the fire extinguishing material", and "call in the local fire department", as successive ones of the detectors are alarmed. The system includes a voltage regulator for supplying a well regulated voltage to the detectors, which regulator is switched into a current limiting mode to prevent an inaccurate first alarm signal if the conductor pair is short circuited. This system also provides a trouble-indicating output signal if the system loses supply voltage or experiences a ripple voltage beyond a preset amplitude.

9 Claims, 12 Drawing Figures

FIG. 3
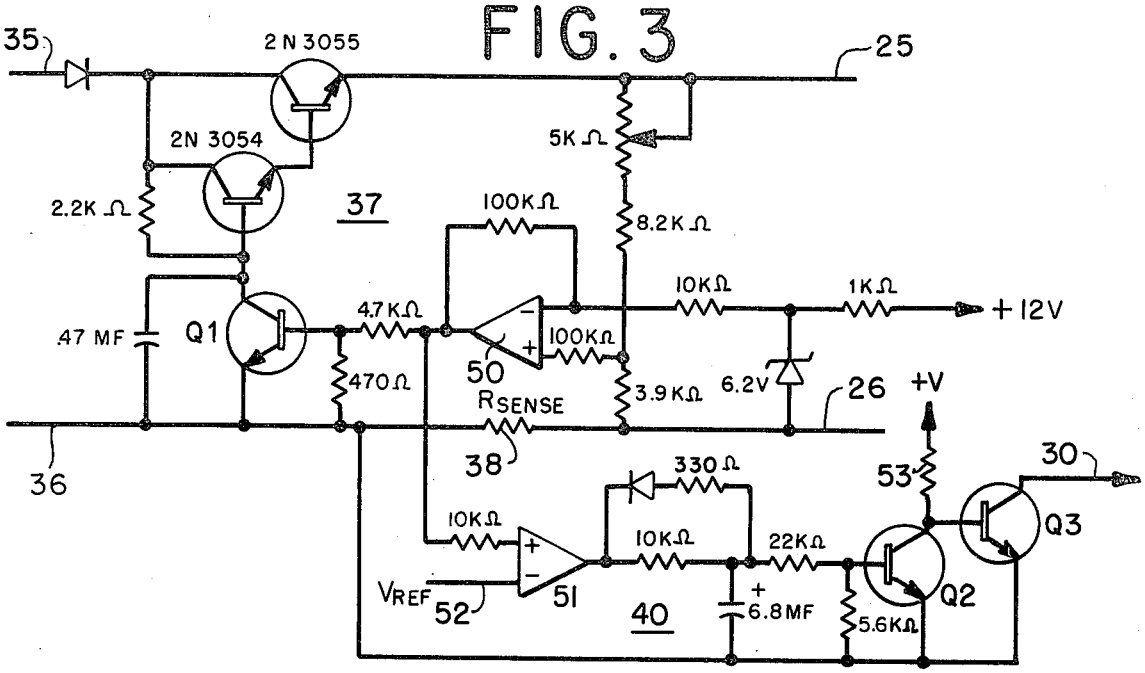
FIG. 5
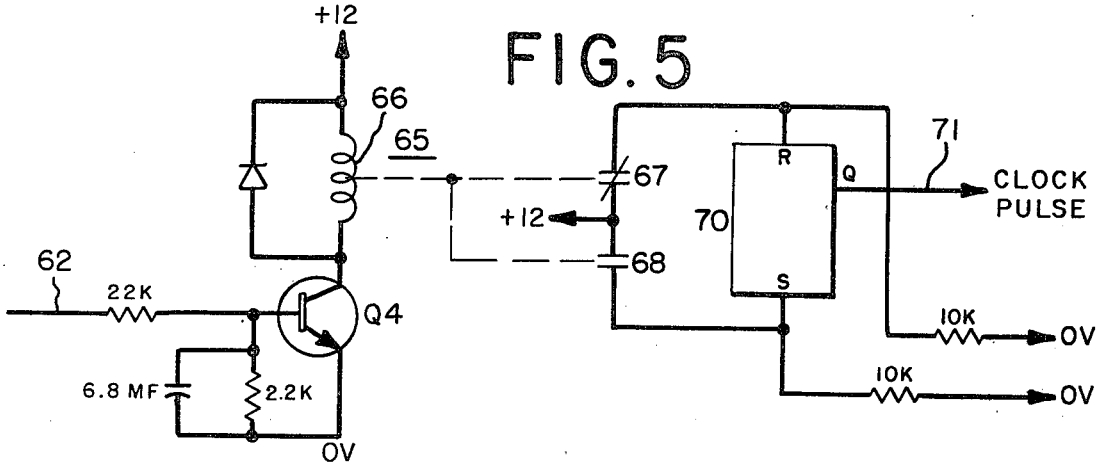
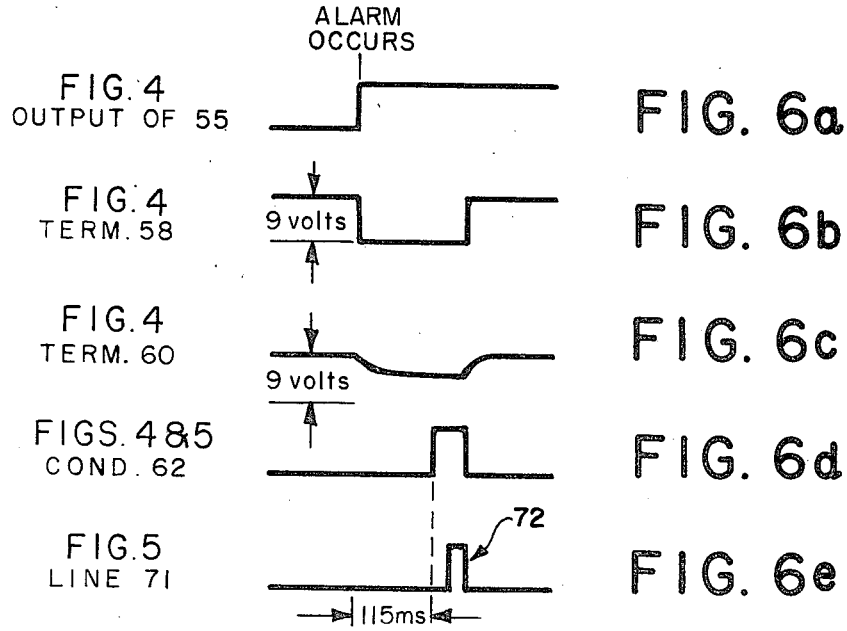

FIRE DETECTION SYSTEM WITH MULTIPLE OUTPUT SIGNALS

BACKGROUND OF THE INVENTION

The present invention is directed to a fire detection system for use with a simple, two-wire arrangement in which spurious alarm signals are avoided. In addition certain functions, such as an evacuation alarm, signalling the fire department, releasing fire extinguishing material, and so forth, can be sequentially initiated responsive to sucessive indications from different detectors.

One early fire detection system connected a plurality of detectors in parallel across the same conductor pair, normally energized by a 24 volt potential difference. A control unit produced the energizing d-c potential difference from an a-c energizing voltage, and the control unit actuated one or more associated pieces of equipment when an individual detector "alarmed", or produced a fire-indicating signal. The "alarmed detector" placed a virtual short circuit across the 24 volt line at the detector location and therefore prevented receipt of subsequent alarm information from other detectors.

This early system was improved by a system termed "cross zoning". In this arrangement all the detectors were not connected in the same loop, but alternate detectors were connected in one loop, and the remaining detectors then connected in another loop. With this arrangement, a first signal is provided from the first loop when any detector on that loop is actuated. A second signal from the other loop is required before extinguishing material (such as Halon 1301) is released to extinguish the fire. This provides an advantage over the earlier system in that the second loop signal "confirms" the presence of a spreading fire condition.

Another detection arrangement, which may be termed "adjacent zoning", has also been developed. In this system there are no pre-defined zones or loops, but when the first detector is alarmed, that detector is established as the center of a zone including all adjacent detectors. If one of those adjacent detectors is then subsequently alarmed, this confirms the signal from the first detector and is used to initiate some action. However, this system requires a dedicated conductor for each detector, in addition to those across which the detectors are normally connected to transmit signals back and forth for establishing a temporary zone in the area of the first-alarmed detector. The additional conductor for each detector thus adds to the complexity and expense of the system.

It is therefore a primary object of the present invention to provide an improved fire detection system which achieves virtually the same benefits as the various zoning schemes, without the necessity of adding additional wires to the system.

Another important object of the invention is to provide such a system with the capability of effecting protective actions in sequence, as successive detectors are alarmed.

SUMMARY OF THE INVENTION

A fire detection system constructed in accordance with the present invention comprises a control unit for providing an energizing potential difference. A pair of conductors is connected to receive the energizing potential difference from the control unit, and a plurality of fire detectors is provided, each being connected in parallel across the conductor pair. The control unit includes circuit means, coupled to the conductor pair, to receive status information from the detectors over the same conductor pair which supplies the energizing potential difference to the detectors.

In accordance with another aspect of the invention, the control unit can provide an output signal responsive to alarm signals from any two detectors in the protected area.

Yet another aspect of the invention is the provision of separate output signals from the control unit in sequence in response to the successive operation of the different detectors connected to the conductor pair.

THE DRAWINGS

In the several figures of the drawings like reference numerals identify like components, and in those drawings:

FIGS. 3, 4 and 5 are schematic diagrams providing circuit details of the subsystems shown more generally in FIG. 2;

Figure 2:
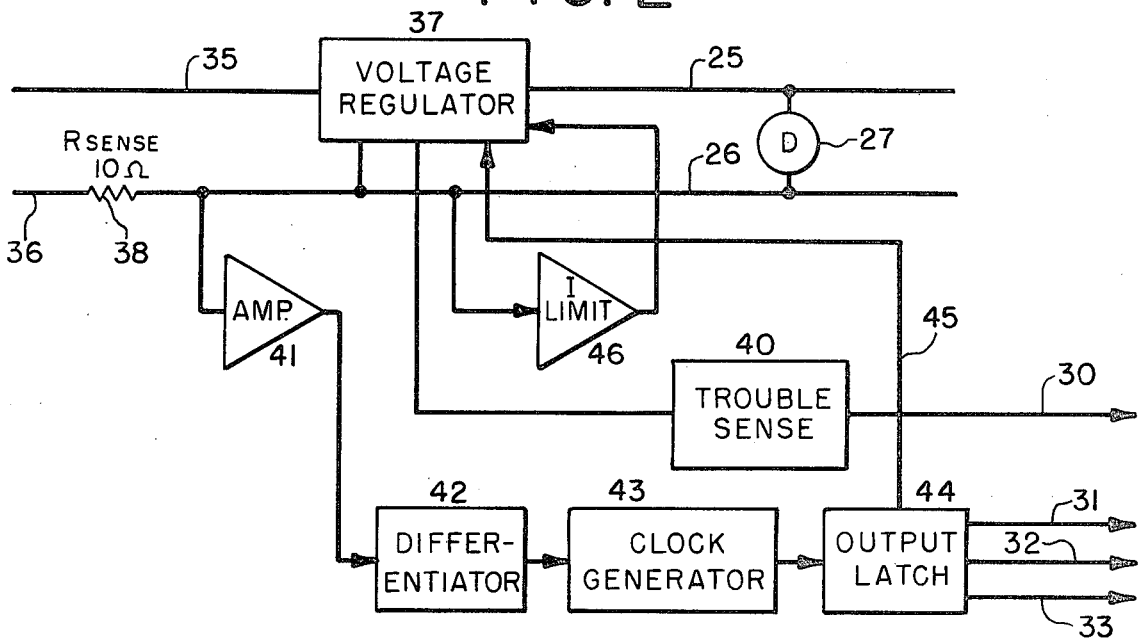
FIG. 2 is a block diagram depicting major subsystems of the control unit.
Figure 7:
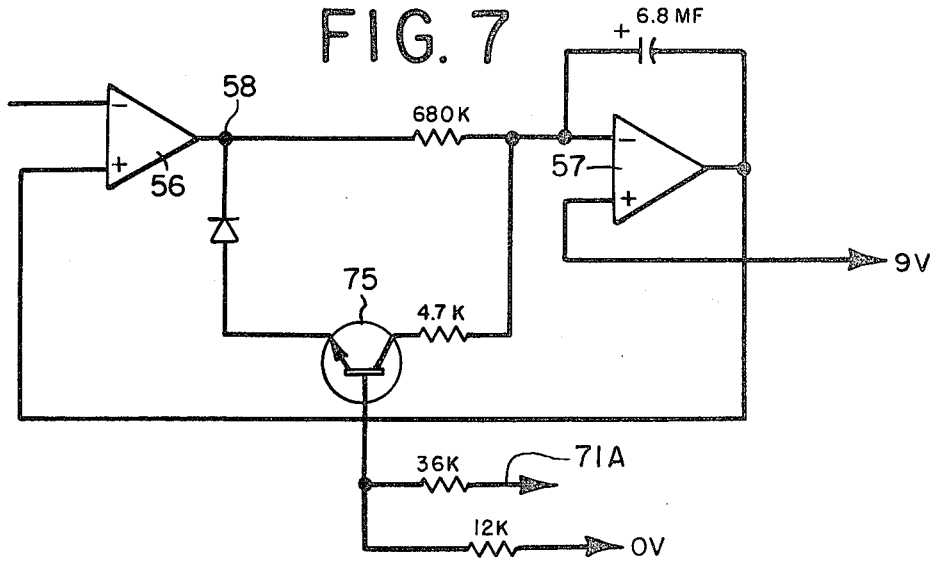
Figure 8:
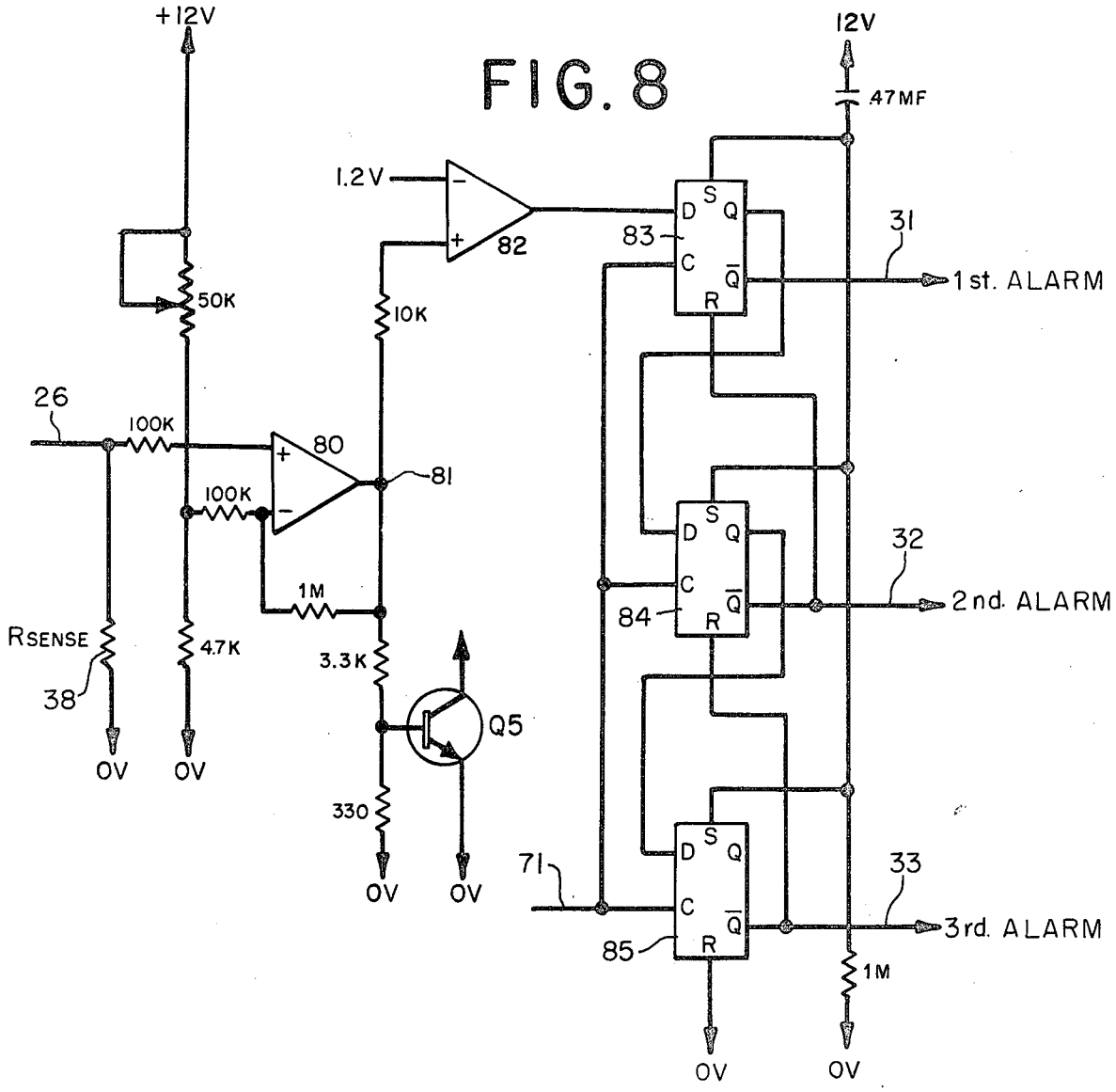

FIGS. *6a–6e* are graphical illustrations useful in understanding operation of the invention; and FIGS. 7 and 8 are schematic diagrams setting out additional circuit details of the subsystems shown in FIG. 2.

DETAILED DESCRIPTION OF THE INVENTION

GENERAL SYSTEM DESCRIPTION

Figure 1:
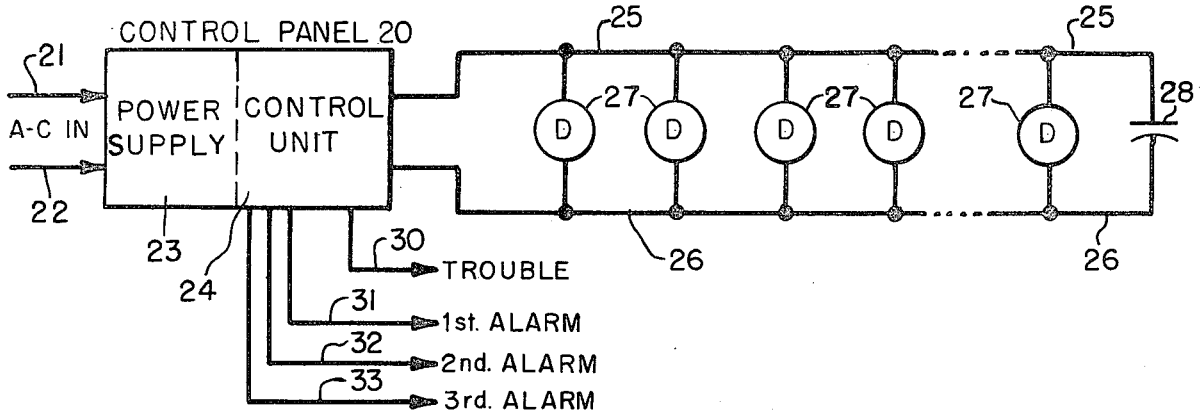
FIG. 1 is a block diagram of a fire detection system including a control unit of the present invention.

FIG. 1 depicts a general arrangement in which a control panel 20 receives alternating-current (a-c) supply energy over a pair of conductors 21, 22. The control panel includes a power supply section 23, for providing a direct current (d-c) energizing potential difference to the control unit portion 24 of the control panel 20. The d-c energizing voltage may be a 24 volt, unregulated potential difference for purposes of explaining this invention. Those skilled in the art will understand that various types of power supplies may be utilized, and different d-c potential levels employed. In the system of FIG. 1, the control unit passes the d-c potential over the conductor pair 25, 26 to energize the plurality of detectors 27. A capacitor 28 is shown as the end-of-line termination component in this embodiment, to avoid drain on the power supply when none of the detectors 27 is alarmed. For purposes of this explanation, each detector 27 can be considered a high impedance under normal conditions. However upon sensing an incipient fire condition, the detector goes into an alarm state and, in effect, provides a low impedance across the conductors 25, 26.

The control unit 24 is effective to provide a "trouble" signal on line 30 when some condition, such as loss of the voltage from power supply 23, is sensed. In addition, control unit 24 is effective to provide first, second and third alarm signals over conductors 31, 32 and 33, respectively, as different ones of the detectors 27 are successively energized. That is, when the first of the detectors 27 is alarmed, a first alarm signal appears on line 31 to signal a first condition, such as "evacuate building". When the second of the detectors—no matter its position along the conductor pair—is alarmed, a signal appears on line 32 to produce a second alarm such as "dump fire extinguishing material". When any additional detector 27 is alarmed, control unit 24 is effective to produce on line 33 a third alarm signal which can be utilized to call in the local fire department or signal any other desired result. Of course, additional alarm levels or signals could be provided, but the three alarm conditions shown with conductors 31–33 are sufficient to illustrate the principles of the invention.

FIG. 2 shows the general arrangement of components within control unit 24. The unregulated d-c supply voltage is passed from the power supply over conductors 35, 36 to the control unit. A voltage regulator stage 37 is connected as shown between lines 35 and 25, and a sensing resistor 38 is coupled between the conductors 36, 26. A trouble sense circuit 40 is coupled to the voltage regulator 37 and operates to provide a signal on line 30 when the voltage at regulator 37 falls below a preset level. An amplifier stage 41 is coupled to one side of sensing resistor 38, to amplify the change in voltage level when any detector is alarmed. The output side of amplifier 41 passes a signal to a differentiator circuit 42, which in turn is coupled to a clock or pulse generator circuit 43. In turn circuit 43 provides a pulse to output latch circuit 44 which includes the three different alarm level conductors 31, 32 and 33. There is a feedback circuit over line 45 from the output latch circuit 44 to voltage regulator circuit 37. A current limit stage 46 is also connected to the voltage regulator. With this general perspective of the control unit 24, a more detailed circuit description will now be set out.

FIG. 3 shows details of the voltage regulator 37 and the trouble sense circuit 40. The voltage regulator receives an unregulated 24 volt supply over lines 35, 36 and provides a regulated 21 volts d-c on lines 25, 26. The filter capacitor is the end-of-line termination component. The 6.2 volt Zener provides the reference voltage for the regulator, to one input terminal of a linear operational amplifier (op amp) 50. The other input to this op amp is from the voltage divider circuit including the 5K trim pot. The op amp 50 attempts to keep its two input voltages at the same level. Thus as its output voltage goes up or down, there is a corresponding variation in the base drive to transistor Q1, which in this embodiment was an MPS AO6 device. Transistor Q1 and the 2.2K resistor act as a voltage divider to provide the required bias at the base terminal of the Darlington connected 2N3054 and 2N3055 to provide a regulated 21 volt potential across the conductor pair 25, 26.

The trouble detector circuit includes another op amp 51 connected as a comparator, with a reference voltage of two volts applied over input conductor 52 to the inverting input connection. The non-inverting input is coupled to the output side of linear op amp 50 in the voltage regulator 37. Thus if the detector line voltage on the conductor pair 25, 26 drops, and the output of op amp 50 goes below two volts, the output of comparator 51 will change state. This comparator also supervises the regulated 12 volt supply within power supply 23. The output of comparator 51 is normally high, and the 6.8 mf capacitor is then charged to about 7 volts. This provides base drive to transistor Q2 which conducts and biases transistor Q3 in the off condition. When a trouble condition occurs, such as loss of the end-of-line capacitor, the output of comparator 51 oscillates due to the unfiltered d-c voltage on the conductor pair 25, 26. The 6.8 mf capacitor acts as a filter to remove the bias from Q2. Q3 is now biased on by resistor 53, providing a trouble signal on conductor 30.

Figure 4:
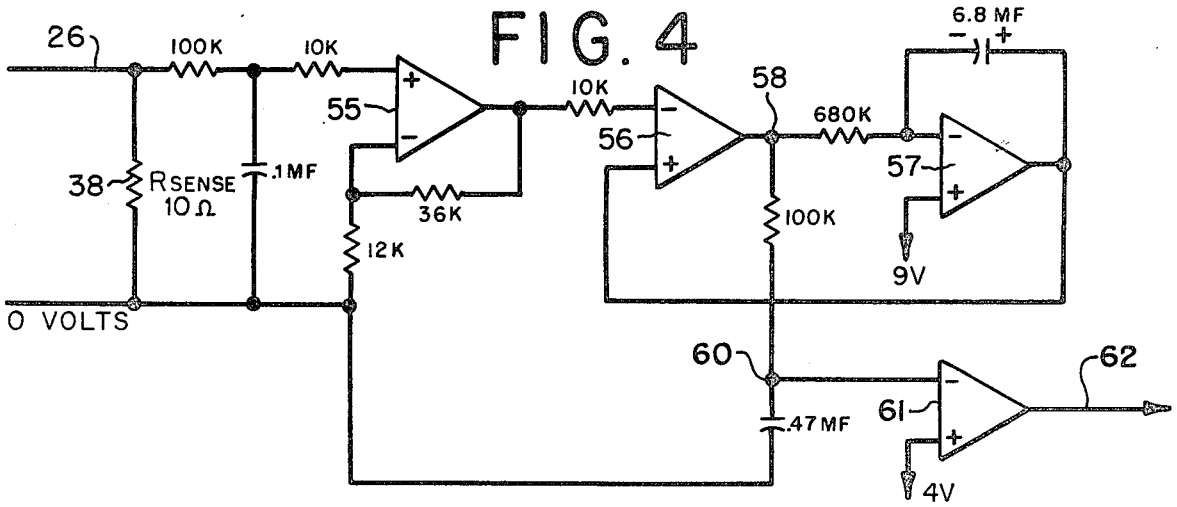

The operation of the system in response to a detector going into alarm will now be considered in connection with FIG. 4. In the stand-by condition before there is any alarm, the only current flow through the 10 ohm sensing resistor 38 is a trickle current from the regulator, of about 7 milliamperes. This provides a voltage drop of 0.07 volt across resistor 38, which is passed to op amp 55. Op amp 55 amplifies this voltage four times, producing a voltage of 0.28 volt at its output side. Op amps 56 and 57 make up a "differentiator". Op amp 56 functions as a comparator, and op amp 57 functions as an integrator, with its output connected to the non-inverting input of comparator 56. The output of comparator 56 provides the current path for the integrating capacitor. The function of the comparator 56 is to adjust the potential across the integrating capacitor until the voltage on both inputs to the comparator 56 are equal. With this condition met, the voltage at terminal 58 is 9 volts. The condition can be met with any voltage, within the common mode range of the device, on the inputs to comparator 56.

As noted previously, the system uses an end-of-line capacitor 28 as a termination. With a 60 hertz a-c supply, there is a slight ripple which provides a current spike every 8.3 millisecond. These spikes pass through op amp 55 and produce a square-wave signal at terminal 58. This square-wave is largely filtered out at point 60, leaving a voltage of about 9 volts at terminal 60.

Considering now the alarm condition, when one of the detectors 27 senses an incipient fire condition, it provides a reduced impedance across the conductor pair 25, 26. This results in a step-function current increase through sensing resistor 38 in the order of 60 to 100 milliamps. The resultant voltage drop is amplified by op amp 55 to provide an output voltage from that stage in the range of 2.4 to 4.0 volts. This drives the output of comparator 56 low, providing a discharge path for the integrating capacitor. The time duration that the output of comparator 56 is low depends on how long it takes for the output of integrator 57 to reach the potential at the inverting input of comparator 56. Since the integrating time constant never varies it follows that the time that the output to comparator 56 is low depends solely on the level of current change across sensing resistor 38. Note that the magnitude of current through resistor 38 is not important; it is only the change in current that is sensed. In addition, when the output side of comparator 56 goes low, the voltage at terminal 60 goes to ground. It requires approximately 80 milliseconds for the 0.47 mf capacitor to discharge to 4.0 volts, at which time the output voltage of op amp 61, on line 62, goes high. Thus any current change through sensing resistor 38 whose duration is less than 80 milliseconds will not cause op amp 61 to change state. In addition, if the change in current through sensing resistor 38 is less than that which is provided when a single detector is alarmed, op amp 61 will not switch. This circuit operation will become more clear after considering the clock pulse generating circuit shown in FIG. 5.

As there shown, the pulse received over line 62 from op amp 61 in FIG. 4 is used to bias on transistor Q4, and complete an energizing circuit for a relay 65 which includes a winding 66, a normally closed contact set 67, and a normally open contact set 68. Relay 65 in its operation changes the potentials applied to the R and S inputs of the R/S flip-flop 70, thus forming a timing clock pulse on output line 71. Use of the relay 65 provides noise immunity from the transient pulses appearing on line 62. Electrical noise or spurious signals resulting from actuation of d-c bells, horns, and so forth, produce considerable noise spikes on line 62 by way of the 12 volt power supply. However the response time of relay 65 is too slow to be actuated by these pulses, and thus the clock pulses on 71 are virtually immune from the noise spikes introduced to the circuit by way of the power supply.

The provision of the clock pulse on line 71 as a result of the functioning of the detector circuit in FIG. 4 is represented in FIGS. *6a–6e*. When the first alarm is sensed by any detector, the output of op amp 55 (FIG. 4) rises, as shown in FIG. *6a*. As previously described, this causes the output voltage from op amp 56, which appears at terminal 58, to go low as shown in FIG. *6b*. The voltage at terminal 60 is driven down from its initial 9 volt level, as described above and shown in FIG. *6c*. It takes approximately 80 milliseconds for the capacitor below terminal 60 to discharge to 4 volts at which time the signal on conductor 62 goes high. This is represented in FIG. *6d*. This pulse in turn is passed to the clock pulse forming circuit in FIG. 5 to provide the clock pulse 72 shown in FIG. *6e*.

Considering the detection circuit shown in FIG. 4, it is again noted that the length of time that the voltage at terminal 58 remains low is a function of the amount of change in the detector current, which develops the voltage across resistor 38. The time of reduced voltage at terminal 58 can vary over a wide range, from about 50 milliseconds to almost one second. Because the system aim is to produce a single clock pulse for each change in current (on line 71, FIG. 5), this same pulse is also used to speed up the recovery time of the circuit of FIG. 4. The details for this speed up are set out in FIG. 7.

As there shown, when clock pulse 72 is provided as already described, this pulse is also fed back over line 71A in FIG. 7 to drive on transistor 75. In effect this places the 4.7 K resistor in parallel with the 680 K resistor that is always in the circuit between terminal 58 and the inverting input to op amp 57. This circuit reduces the recovery time to about 20 milliseconds, after the clock pulse on line 72 has gone high. Thus any time a single detector alarms, the total "dead time" of the circuit will be about 115 milliseconds, which is the sum of the 80 milliseconds for the production of the leading edge of the pulse on line 62, plus the 20 milliseconds from the just-described circuit including transistor 75, and an additional 15 milliseconds for the relay pull-in time and the switching time of flip-flop 70.

As described above, the change in current through sensing resistor 38 must be present for 115 milliseconds before an alarm output signal is obtained. This important feature prevents spurious signals from producing a false alarm. From practical considerations, the delay should not be too long in order to minimize the possibility of two detectors both alarming during the 115 millisecond "dead time", which would appear to the system to be a single alarm.

The actual current level detection circuit is shown in FIG. 8. The input to the circuit including conductor 26 and the current sensing resistor 38 is common to the input of the clock pulse producing circuit shown in FIG. 4. It is important that the first alarm signal provided on line 31 (FIG. 8) should not occur as the result of a short circuit across conductors 25, 26. Toward this end a current limiting function is achieved by amplifier 80, which has a reference voltage of 2.3 volts applied to its inverting input. When the current through the sensing resistor approaches 230 milliamperes, the signal at the output side (terminal 81) of amplifier 80 rises. When this voltage level reaches about 6 volts, there is sufficient base drive to turn transistor Q5 on. Transistor Q5 is connected in parallel with transistor Q1 in FIG. 3. Accordingly, at this voltage level (about 6 volts at terminal 81) the voltage regulator of FIG. 2 becomes a current regulator as represented by the block 46 in that circuit. The control voltage for the regulator 37 is adjusted to limit the current through the sensing resistor 38 to 230 milliamperes. When the output of op amp 80 at terminal 81 exceeds 1.2 volts, the reference level applied to the inverting input of comparator 82, its output applies a high signal to the D input of the first R/S flip-flop 83 in the alarm signal chain. This occurs long before the action described in connection with FIGS. 4 and 5, which resulted in the application of the clock pulse over line 71 to the C (clock) input connections of the three R/S flip-flops. The clock pulse will drive the Q output of first flip-flop 83 into the zero or low state, and thus prevent an alarm which would otherwise be simulated by a short circuit across conductors 25, 26. However, if the first clock pulse on line 71 is the result of a true alarm signal and not a short circuit, then the voltage level at terminal 81 will not have exceeded 1.2 volts, the output of comparator 82 will remain low, and the clock pulse on line 71 will cause the output of Q to go high and provide the "first alarm" signal on line 31. The Q output goes low which is applied to the D input of the second flip-flop 84, conditioning the second stage to provide the "second alarm" on line 32 when the second clock pulse is received on line 71. In turn the third flip-flop 85 is conditioned in the same manner, so that the next clock pulse will turn it on in exactly the same manner. In this way discrete and separate output signals are provided on the conductors 31, 32 and 33 as the first, second and third detectors are alarmed, no matter their position in the circuit. This provides a confirmation or adjacent-detector type of signalling without the complexity of a third wire for the system.

When the system is reset all the outputs on lines 31–33 are de-energized. The recovery time for the alarm sensing circuit is the time required for the negative side of the 6.8 mf capacitor (FIGS. 4 and 7) to charge to 0.28 volt. During this interval the circuit may not respond to an alarm. It will go into alarm only if the amplitude of the alarm signal exceeds the capacitor voltage, at the output side of op amp 57 in FIGS. 4 and 7, sufficiently to keep the voltage at terminal 58 low for 115 milliseconds.

What is claimed is:

1. A fire detection system comprising:

a control unit for providing an energizing potential difference;

a pair of conductors connected to receive the energizing potential difference from the control unit;

a plurality of fire detectors, each connected in parallel accross said conductor pair, and each of which signals an alarm in the same manner, by presenting a low impedance across said conductor pair; and circuit means in said control unit, coupled to said conductor pair to receive status information from the detectors over the same conductor pair which supplies the energizing potential difference to the detectors, which control unit is effective to provide a first alarm output signal when a first one of the detectors is alarmed, and to provide a second alarm output signal when any of the remaining detectors is subsequently alarmed.

2. A fire detection system as claimed in claim 1, and further comprising means in said control unit, effective to modify operation of the system such that said first alarm output signal is prevented when a short circuit appears across the pair of conductors supplying the detectors and an audible trouble signal is produced.

3. A fire detection system as claimed in claim 1, and in which said circuit means in the control unit is also effective to provide an additional alarm output signal when any of the remaining detectors is subsequently alarmed.

4. A fire detection system as claimed in claim 3, and further comprising a delay stage connected to provide the first alarm output signal and succeeding alarm output signals only when a low impedance is present across the conductor pair for a predetermined minimum time period extending up to five seconds.

5. A fire detection system as claimed in claim 4, in which said predetermined minimum time period is in the range of from 0.05 to 1.0 second.

6. A fire detection system comprising:

two, and only two, conductors extending throughout an area to be protected;

a plurality of fire detectors, each coupled between the conductor pair at different physical locations throughout the area, and each of which signals an alarm in the same manner, by presenting a low impedance across said conductor pair;

termination means exhibiting a capacitive reactance and coupled to the end of said conductor pair;

a control unit connected to supply a d-c potential difference between said conductors; and circuit means in said control unit, coupled to said conductor pair to receive detector status information over the same two conductors which pass the d-c energizing potential difference to the detectors, which control unit is effective to provide a first alarm output signal when the first one of the detectors is alarmed, and to provide a second alarm output signal when any of the remaining detectors is subsequently alarmed.

7. A fire detection system as claimed in claim 6, and in which said circuit means in the control unit is also effective to provide an additional alarm output signal when any of the remaining detectors is subsequently alarmed.

8. A fire detection system as claimed in claim 7, and having a delay stage for providing the first alarm output signal and succeeding alarm output signals only when a low impedance is present across the conductor pair for a predetermined minimum time period extending up to five seconds.

9. A fire detection system as claimed in claim 8, in which said predetermined minimum time period is in the range of from 0.05 to 1.0 second.

* * * * *